US007113157B2

(12) United States Patent
Shih

(10) Patent No.: US 7,113,157 B2
(45) Date of Patent: Sep. 26, 2006

(54) DRIVING CIRCUIT FOR ORGANIC LIGHT EMITTING DIODE

(75) Inventor: Li-Wei Shih, Chia-Yi Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 520 days.

(21) Appl. No.: 10/605,953

(22) Filed: Nov. 10, 2003

(65) Prior Publication Data

US 2004/0196221 A1 Oct. 7, 2004

(30) Foreign Application Priority Data

Apr. 7, 2003 (TW) ..... 92107924 A

(51) Int. Cl.
*G09G 3/32* (2006.01)

(52) U.S. Cl. ..... 345/84

(58) Field of Classification Search ..... 345/46, 345/48, 82, 84, 98, 100; 315/169.1, 169.2, 315/169.3

See application file for complete search history.

(56) References Cited

U.S. PATENT DOCUMENTS

2002/0084967 A1* 7/2002 Akimoto et al. ..... 345/90
2003/0076282 A1* 4/2003 Ikeda et al. ..... 345/55
2005/0168491 A1* 8/2005 Takahara et al. ..... 345/690
2005/0180083 A1* 8/2005 Takahara et al. ..... 361/152
2005/0285822 A1* 12/2005 Reddy et al. ..... 345/76
2006/0007249 A1* 1/2006 Reddy et al. ..... 345/690

* cited by examiner

*Primary Examiner*—Amare Mengistu
(74) *Attorney, Agent, or Firm*—Winston Hsu

(57) ABSTRACT

A driving circuit for driving an organic light emitting diode (OLED) includes a first transistor having drain and source respectively connected to a power voltage and an OLED, an inverter having an output connected to a gate terminal of the first transistor, an input circuit having an output connected to an input of the inverter for inputting data, and a voltage-dropping circuit connected to the output of the input circuit for dropping a voltage at the output of the input circuit. The driving circuit drives the OLED to emit light according to a data input received at the input circuit.

9 Claims, 5 Drawing Sheets

DRIVING CIRCUIT FOR ORGANIC LIGHT EMITTING DIODE

BACKGROUND OF INVENTION

1. Field of the Invention

The present invention relates to an organic light emitting diode (OLED), and more particularly, to a driving circuit for driving the OLED by determining input data.

2. Description of the Prior Art

Having a variety of advantages, such as high light intensity, high response velocity, wide viewing angle, spontaneous light source and thin bulk, an organic light emitting diode (OLED) is becoming one of the most popular light emitting components that form a display device. Since an OLED is a current-driving component, the intensity (gray scale) of light emitted by an OLED can be controlled by determining levels of currents flowing therethrough.

A voltage-driving method, a method for driving an OLED by determining currents flowing therethrough, controls a voltage at a gate of a thin film transistor (TFT), which is connected to an OLED, and currents flowing through the OLED, and adjusts light intensity of the OLED. The larger the voltage difference between the gate and a source of the TFT is, the stronger the currents flowing through the OLED become, and so does the corresponding gray scale. On the contrary, if the voltage difference between the gate and the source of the TFT is becoming smaller, levels of the currents flowing through the OLED are becoming weaker and the light intensity of the OLED becomes fainter gradually, generating the gray scale of a small value.

Though a TFT fabricated in a low temperature polysilicon process has an advantage of high carrier mobility, which promotes the performance of an OLED driven by the TFT dramatically, in the process of fabricating TFTs, two TFTs of the same type usually have two unequal threshold voltages, resulting in a problem of uneven image-displaying. That is, two same-typed TFTs can only generate two kinds of current levels even if these two TFTs are applied by two identical driving voltages respectively, resulting that two OLEDs driven by two same-typed TFTs applied by two identical driving voltages can only emit lights with two different levels of intensity instead of generating two gray scales of the same value, restricting the practicality of the OLEDs. However, currents generated by two same-typed TFTs operated on a saturation region differ slightly even if these two TFTs have two unequal threshold voltages, so driving TFTs, which control operations of OLEDs, into the saturation region enables these TFTs themselves to generate currents with equal levels despite that the threshold voltages of these TFTs differ from each other. In this scenario, levels of gray scale performed by an OLED can be adjusted by determining how long a period when currents flow through the OLED is.

A pulse width modulation (PWM) method is a method to control the intensity of light emitted by an OLED by providing a constant current to flow through the OLED and by controlling the period when the current is to flow through the OLED. Please refer to FIG. 1, which is a timing diagram of the PWM method according to the prior art. The PWM method divides a frame SF into N (N is equal to 6 in this example) subframes $SF_0$ to $SF_5$ according to a gray scale $2^N$. The subframes $SF_0$ to $SF_5$ each comprise a data-writing period and a data-displaying period. For example, the subframe $SF_0$ comprises a data-writing period $TV_0$ and a data-displaying period $TL_0$, and likewise do the subframes $SF_1$ to $SF_5$. A TFT that controls an OLED to emit light can be driven into a cutoff region or into the saturation region during data-writing periods of an identical length in every frame by a constant voltage according to digital input data, which are transformed from analog input data by an analog digital converter (not shown), and then generates a constant current that controls the OLED to emit light of equal intensity while being driven into the saturation region. Therefore, depending on operating on the cutoff or saturation region, the TFT controls the OLED not to emit light or to emit light for a period corresponding to the length of a data-writing period and controls the OLED to demonstrate gray scale of different values according to the input data.

For example, the levels of the gray scale are assumed to be equal to 64, and the frame SF is to be divided into six subframes $SF_0$ to $SF_5$ and a length ratio between the data-displaying period of the subframes $SF_0$ to $SF_5$ is 1:2:4:8:16:32. If what the OLED is to perform has a gray scale of 27, the constant voltage drives the TFT into the saturation region during the data-writing period $TV_0$, $TV_1$, $TV_3$ and $TV_4$ of the subframe $SF_0$, $SF_1$, $SF_3$ and $SF_4$ (27=1+2+8+16) and the OLED emits light during the data-displaying period $TL_0$, $TL_1$, $TL_3$ and $TL_4$. In another example, if what the OLED is to perform has a gray scale of 55, the constant voltage drives the TFT into the saturation region during the data-writing period $TV_0$, $TV_1$, $TV_2$, $TV_4$ and $TV_5$ of the subframe $SF_0$, $SF_1$, $SF_2$, $SF_4$ and $SF_5$ (55=1+2+4+16+32) and the OLED emits light during the data-displaying period $TL_0$, $TL_1$, $TL_2$, $TL_4$ and $TL_5$. The PWM method generates a gray scale corresponding to input data by controlling the length of time for the OLED to emit light ($27/55=(TL_0+TL_1+TL_3+TL_4)/(TL_0+TL_1+TL_2+TL_4+TL_5)$) and overcomes the drawback of unevenly-displaying image performed by an OLED driven by a TFT under the voltage-driving method.

However, in the process of controlling the OLED to emit light under the PWM method, no matter what the input data are, the OLED does not emit light during any data-writing period. That is, the light efficiency of the OLED can only be as high as a ratio between the total length of time of the data-displaying periods and the length of time of the frames ($(TL_0+TL_1+TL_2+TL_3+TL_4+TL_5)/(SF_0+SF_1+SF_2+SF_3+SF_4+SF_5)$), therefore reducing the light efficiency of the OLED. Moreover, as the gray scale increases, the number of the subframes has to increase accordingly. Therefore, the length of time that each of the subframes can share with decreases. A subframe of a shorter period indicates a data-writing of a shorter period. An OLED driving circuit usually increases/decreases a voltage level of a capacitor by charging/discharging the capacitor and controls the intensity of light emitted by an OLED. Too short a data-writing period cannot provide the driving circuit enough time to charge/discharge the capacitor to a voltage exactly corresponding to the input data. In addition, as the working frequency of the OLED increases, the length of time of the display SF, as well as the data-writing period of each frame, decreases accordingly. Although a capacitor of a larger capacitance can be used to overcome the drawback, such a capacitor can only occupy large area, contradictory to the principles of light weight and small bulk that a modern integrated circuit demands. In such a scenario, the PWM method can only control an OLED to display an image of a gray scale of a limited numbers under a presumption that the capacitance of a capacitor cannot over a predetermined value. Another drawback of the prior art the PWM method is that it can only deal with digital input data. Therefore, the PWM method further needs an analog digital converter to convert analog input data into digital input data, increasing the cost of the driving circuit.

SUMMARY OF INVENTION

It is therefore an object of the invention to provide an OLED driving circuit that can overcome the drawbacks of the prior art.

According to the claimed invention, the driving circuit comprises a first transistor having drain and source respectively connected to a power voltage and to the OLED, an inverter having an output connected to a gate terminal of the first transistor, an input circuit having an input receiving a data signal and an output connected to an input of the inverter, and a voltage-reducing circuit connected to the output of the input circuit for reducing a voltage at the output of the input circuit. The first transistor is a TFT transistor.

It is an advantage of the claimed invention that a driving circuit drives the OLED to emit light proportionally according to data received at the input circuit. It is another advantage of the claimed invention that a driving circuit can deal with digital as well as analog data, reducing the cost of the driving circuit.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
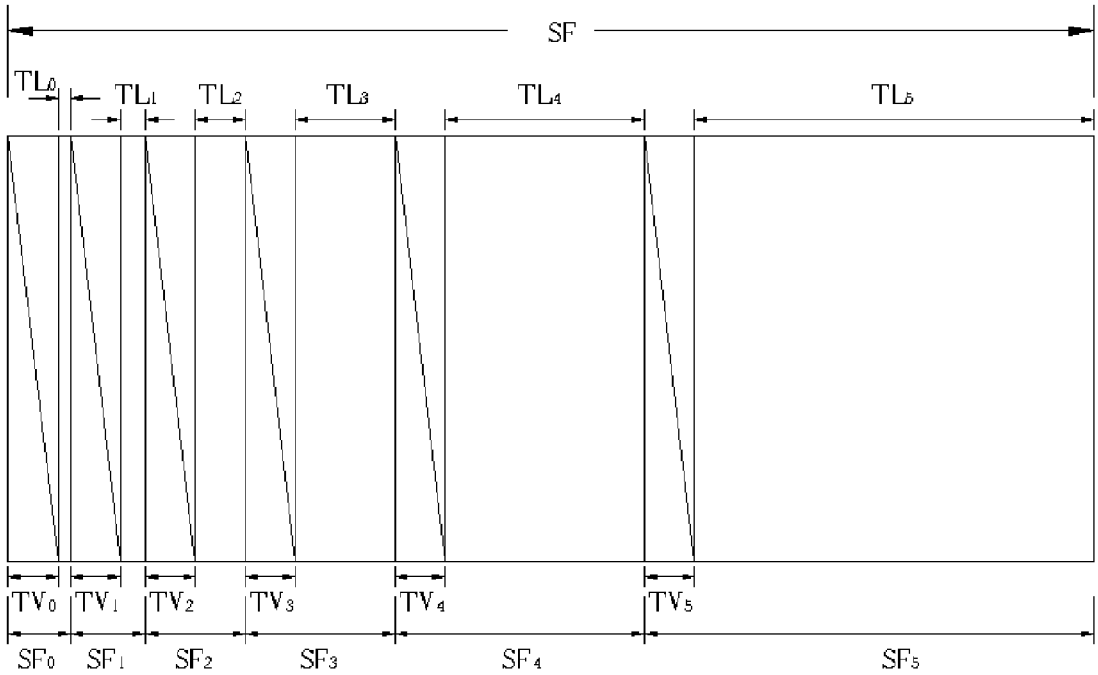
Fig. 1 Prior art
FIG. 1 is a timing diagram of a PWM method known in the prior art.
Figure 2:
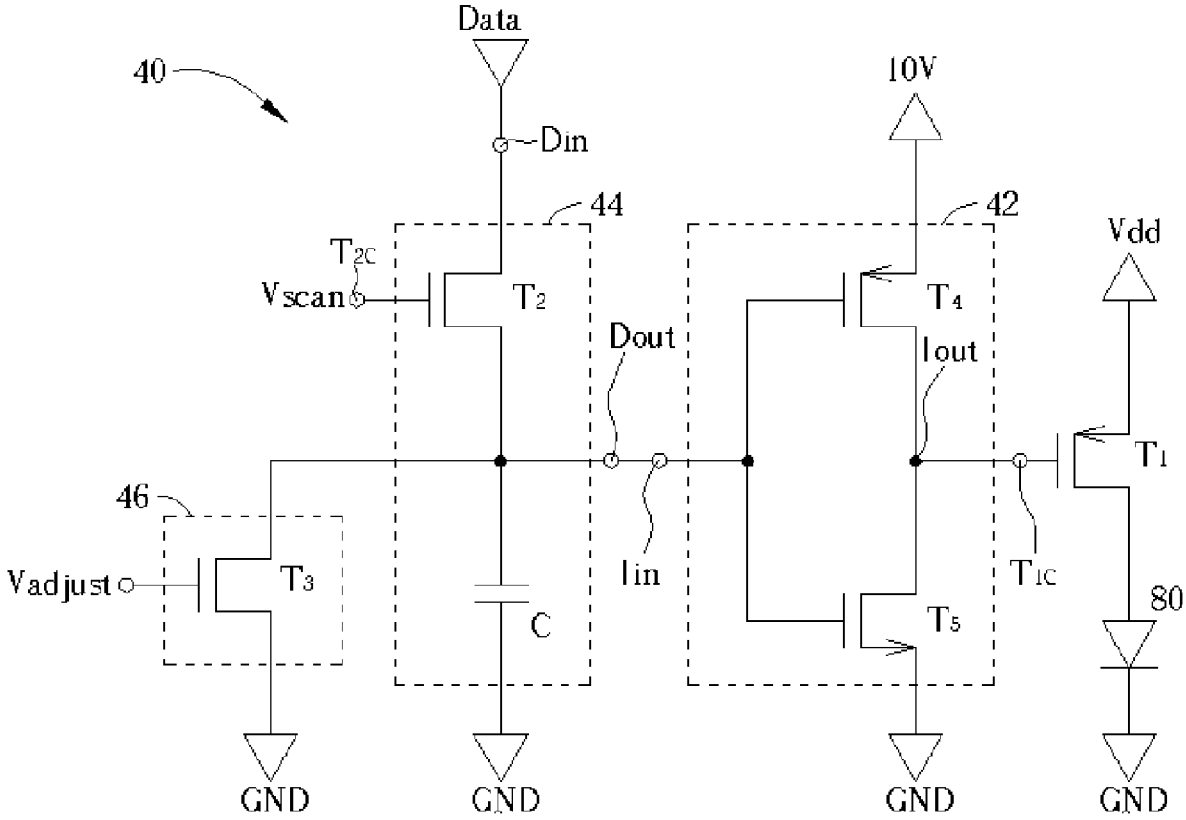
FIG. 2 is a circuit diagram of a driving circuit according to an embodiment of the present invention.

Please refer to FIG. 2, which is a circuit diagram of a preferred embodiment of a driving circuit 40 to drive an OLED 80 according to the present invention. The driving circuit 40 comprises a first transistor $T_1$ for controlling the OLED 80 to emit light, an inverter 42, an input circuit 44 for inputting data (digital or analog), and a voltage-reducing circuit 46 connected to an output end $D_{out}$ of the input circuit 44 for reducing the voltage level at the output end $D_{out}$ of the input circuit 44. A drain of the first transistor $T_1$ is connected to a voltage source $V_{dd}$, and a source of the first transistor $T_1$ is connected to the OLED 80. An output $I_{out}$ of the inverter 42 is connected to a gate terminal $T_{1c}$ of the first transistor $T_1$, and an input $I_{in}$ of the inverter 42 is connected to the output $D_{out}$ of the input circuit 44. In the preferred embodiment of the present invention, the voltage-reducing circuit 46 comprises a third transistor $T_3$, and the input circuit 44 comprises a second transistor $T_2$ and a capacitor C connected to the output $D_{out}$ of the input circuit 44. Source/drain terminals of the second transistor $T_2$ are connected to an input $D_{in}$ and the output $D_{out}$ of the input circuit 44 respectively. A gate terminal $T_{2c}$ of the second transistor $T_2$ is connected to a scan voltage $V_{scan}$. The inverter 42 is a CMOS inverter. That is, the output $I_{out}$ sets to a high voltage level when a voltage at the input $I_{in}$ is lower than a threshold voltage $V_n$ of the CMOS transistors; conversely the output $I_{out}$ sets to a low voltage level when a voltage at the input end $I_{in}$ is higher than the threshold voltage $V_n$. The first transistor $T_1$ can be a TFT.

The operations performed by the driving circuit 40 comprise writing and storing data into the capacitor C during a data-writing period, and driving the first transistor $T_1$ into the saturation region to generate a constant current and drive the OLED 80. A frame for the driving circuit 40 comprises, however, only one data-writing period and one data-displaying period.

Exemplary operations of the driving circuit 40 are described hereafter. In a data-writing period, a scan voltage $V_{scan}$ at the gate terminal $T_{2c}$ turns on the second transistor $T_2$, which writes and stores data into the capacitor C.

The operation of the third transistor $T_3$ is controlled via an adjust voltage $V_{adjust}$. When the third transistor $T_3$ is turned on, the voltage-reducing circuit 46 forms a constant current source to provide a constant current to discharge the capacitor C. Modifying the adjust voltage $V_{adjust}$ enables to adjust the level of the constant current and change the discharging rate of the capacitor C. Charges stored in the capacitor C may flow out through the turned-on transistor $T_3$ meanwhile data are being inputted into the capacitor C via the input $D_{in}$ of the transistor $T_2$. To secure a correct data storage in the capacitor C, the discharge rate can be controlled to be smaller than a data writing rate during the data-writing period by adjusting the level of the adjust voltage $V_{adjust}$.

The charged capacitor C creates a voltage level at input $D_{in}$ higher than the threshold voltage $V_n$ of the CMOS of the inverter 42, so that a resulting low voltage level at the output $I_{out}$ creates an adequate gate-source voltage to drive the first transistor $T_1$ in operation in the saturation region.

Figure 3:
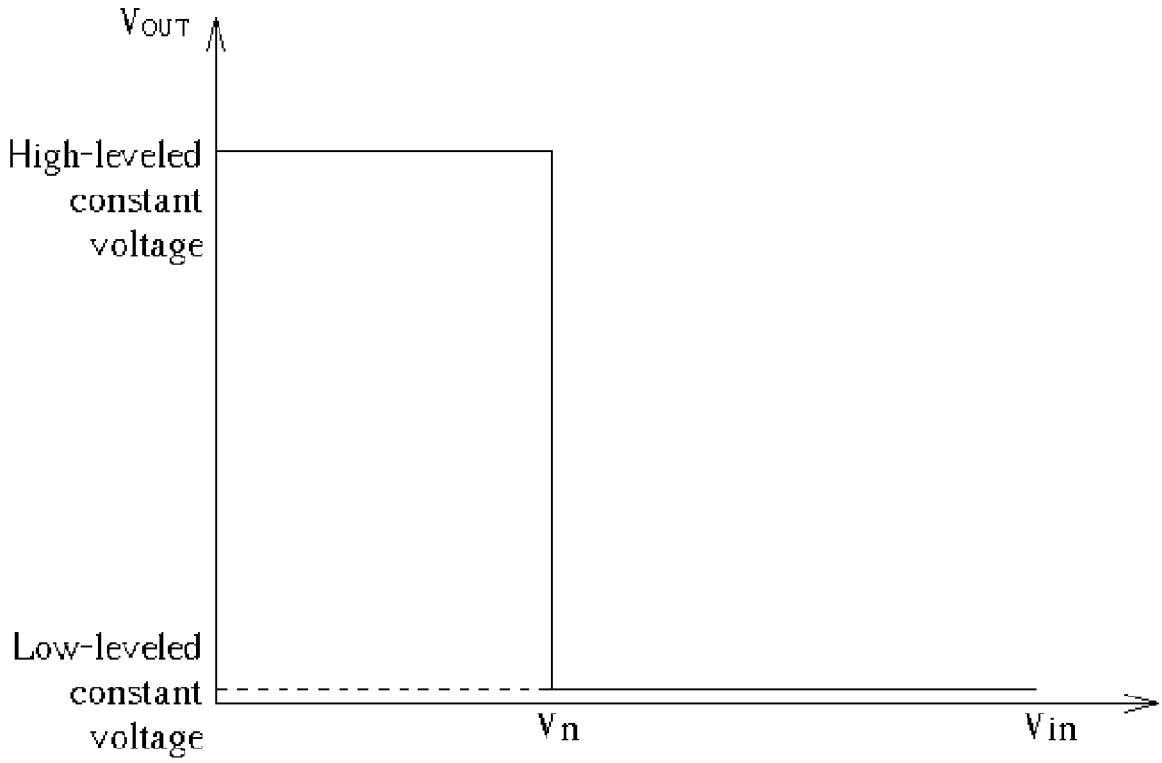
FIG. 3 is a timing diagram of an inverter implemented in a driving circuit according to an embodiment of the present invention.

FIG. 3 is a timing diagram of the inverter 42 operated according to an embodiment of the present invention. When the input voltage $V_{in}$ at the input $I_{in}$ of the inverter 42 is lower than the threshold $V_n$, the output $I_{out}$ sets to a constant high voltage level. Conversely, an input voltage $V_{in}$ at the input $I_{in}$ higher than the threshold $V_n$ sets the output $I_{out}$ to a constant low voltage level. The difference of currents generated from TFTs operating in the saturation region is so small that the driving circuit 40 can drive light emission of the OLED 80 with an approximately constant intensity.

The third transistor $T_3$ operates as a constant current source, capable of linearly leaking off charges stored in the capacitor C. When a voltage of the capacitor C drops below the threshold voltage $V_n$ of the CMOS of the inverter 42 due to the discharging effect of the third transistor $T_3$, a voltage at the output $I_{out}$ will rise to a high voltage level to turn off the first transistor $T_1$ and, consequently, the OLED 80. Under the influence of the third transistor $T_3$ acted as the constant current source, the duration of light emission of the OLED 80 is modified according to the data signal set at the input $D_{in}$ of the input circuit 44. The OLED 80 thereby can exhibit a range of gray scale according to the inputted data. If the data signal level is high, the charged capacitor C being leaked by the constant current source discharges for a longer time until it reaches the threshold voltage $V_n$ of the CMOS of the inverter 42. As a result, the duration of light emission of the OLED 80 is longer. Conversely, if the data signal is lower, the duration of light emission is shorter.

Figure 4:
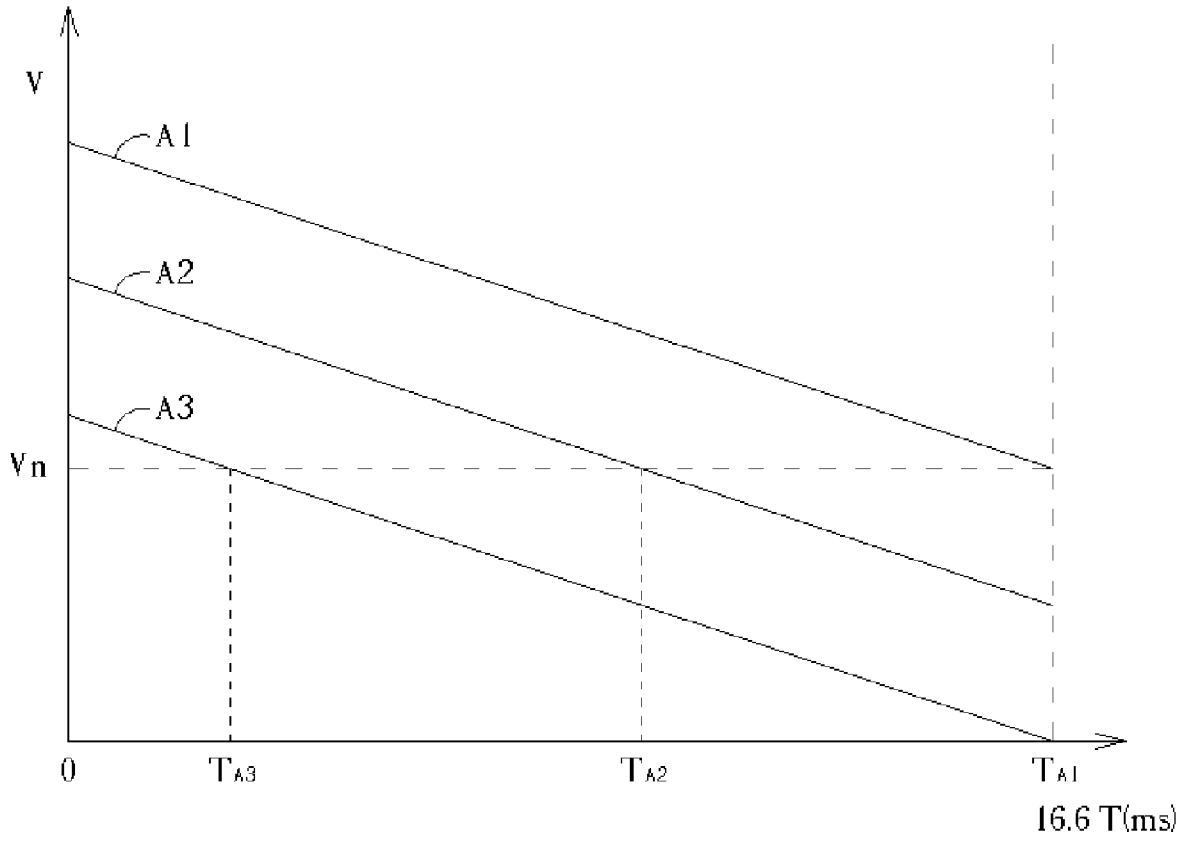
FIG. 4 is a timing diagram of a capacitor implemented in a driving circuit according to an embodiment of the present invention.

FIG. 4 is a timing diagram of the capacitor C operated according to an embodiment of the invention. Three data signals A1, A2 and A3, having different signal levels are respectively set at the input $D_{in}$ of the input circuit 44. Being subject to discharging from the voltage-reducing circuit 46, a voltage level of the capacitor C drops linearly. When the voltage drop of the capacitor C is lower than the threshold voltage $V_n$, the OLED 80 stops emitting light. FIG. 4 shows that a higher data signal input (such as data A1) will result in a longer discharge time of the capacitor C, and consequently a longer time duration of light emission of the OLED 80, corresponding to a gray scale of a high level. In contrast, the time $T_{A3}$ needed for the capacitor C to drop from a voltage level corresponding to the data signal A3 to a voltage level lower than the threshold voltage $V_n$ is the shortest, corresponding to a gray scale of a low level.

Figure 5:
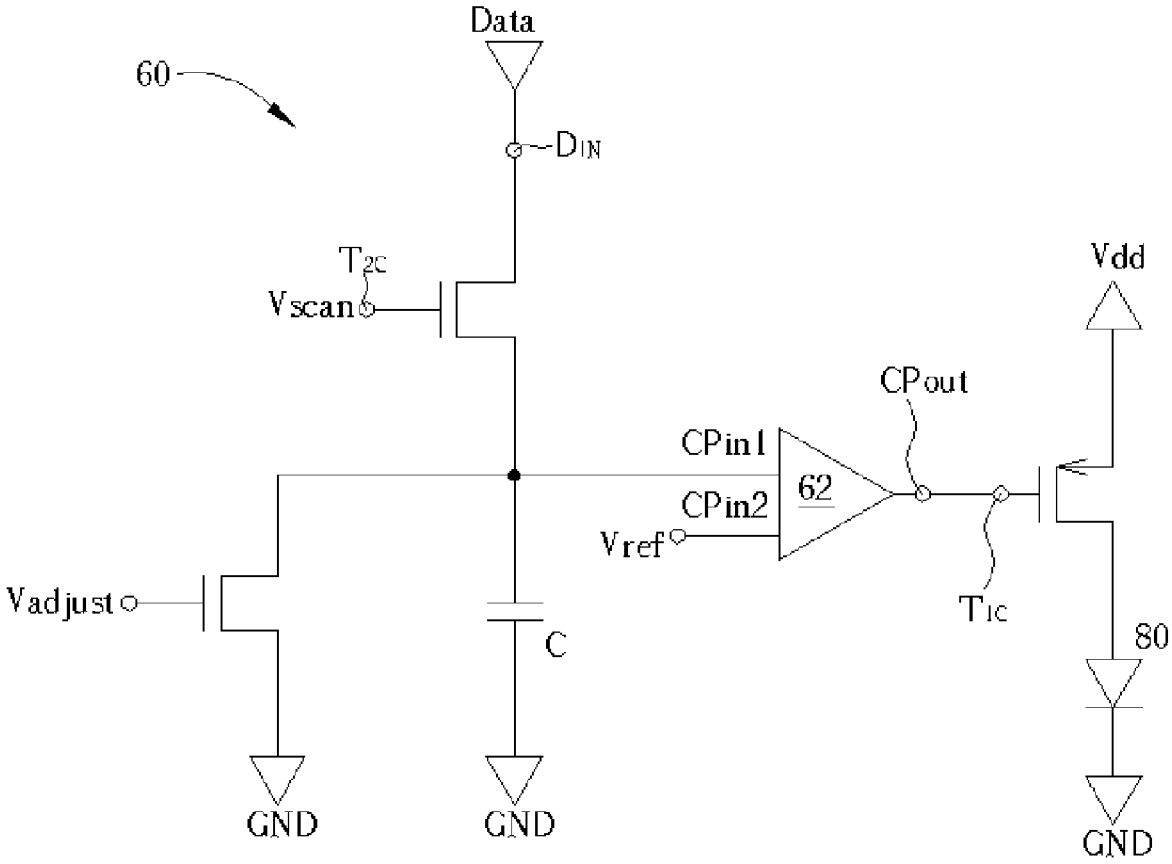
FIG. 5 is a circuit diagram of a driving circuit according to another variant embodiment of the present invention.

FIG. 5 is a circuit diagram of a driving circuit 60 according to a variant embodiment of the invention. In a variant example, a comparator 62 can substitute for the inverter of the driving circuit. An output $CP_{out}$ of the comparator 62 is connected to the gate terminal $T_{1c}$ of the first transistor $T_1$, a first input $CP_{in1}$ of the comparator 62 is connected to the output $D_{out}$ of the input circuit 44, and a second input $CP_{in2}$ of the comparator 62 is connected to a reference voltage $V_{ref}$. When a voltage level at the input $CP_{in1}$ (corresponding to output $D_{out}$ of the input circuit 44) is higher than the reference voltage $V_{ref}$ the output $CP_{out}$ of the comparator 62 sets to a low voltage level to turn on the first transistor $T_1$. Conversely, a voltage level at the input $CP_{in1}$ lower than the reference voltage Vref results in a high voltage level at the output $CP_{out}$ to turn off the first transistor $T_1$ and, consequently, the OLED 80. The driving circuit 60 operates in a manner similar to the foregoing description of the driving circuit 40.

The driving circuit of the present invention includes at least the following characteristics:

1) The TFT transistor $T_1$ of the driving circuit 40, 60 is driven to operate in the saturation region so that OLEDs effectively exhibit a same level of intensity when data of equal values are inputted.

2) The duration of light emission of the OLED proportionally depends on the data signal level received at the input circuit. The OLED thereby can be driven to exhibit a wide range of gray scale level.

3) The driving circuit operates in accordance with a PWM method of a single modulation period, inputting data during a data-writing period of the single modulation period while discharging a capacitor during a data-displaying period of the single modulation period. The efficiency of the driving circuit is improved by decreasing the data-displaying period of the single modulation period and by controlling the voltage-reducing circuit to generate a constant current.

4) The driving circuit is compatible with not digital data as well as analog data, diminishing the need for an ADC.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving circuit for driving an organic light emitting diode (OLED), the driving circuit comprising:

a first transistor, having a drain and a source connected to a power voltage and the OLED respectively;

an inverter, having an output connected to a gate terminal of the first transistor;

an input circuit for inputting data, having an output connected to an input of the inverter; and a voltage-reducing circuit, connected to the output of the input circuit for reducing a voltage at the output of the input circuit.

2. The driving circuit of claim 1, wherein the first transistor is a thin film transistor (TFT).

3. The driving circuit of claim 1, wherein the inverter is a CMOS inverter.

4. The driving circuit of claim 1, wherein the input circuit comprises:

a second transistor, having source and drain connected to the input and the output of the input circuit respectively; and a capacitor, having a first end connected to the output of the input circuit.

5. The driving circuit of claim 1, wherein the voltage-reducing circuit comprises a third transistor.

6. A driving circuit for driving an OLED, the driving circuit comprising:

a first transistor, having drain and source connected to a power voltage and the OLED respectively;

a comparator, having a first input and an output connected to a reference voltage and to a gate terminal of the first transistor respectively;

an input circuit for inputting data, having an output connected to a second input end of the comparator; and a voltage-reducing circuit, connected to the output of the input circuit for reducing a voltage at the output of the input circuit.

7. The driving circuit of claim 6, wherein the first transistor is a TFT.

8. The driving circuit of claim 6, wherein the input circuit comprises:

a second transistor, having source and drain connected to an input and the output of the input circuit respectively; and a capacitor, having a first end connected to the output of the input circuit.

9. The driving circuit of claim 6, wherein the voltage-reducing circuit comprises a third transistor.

* * * * *